US007267086B2

(12) United States Patent
Allen et al.

(10) Patent No.: US 7,267,086 B2
(45) Date of Patent: Sep. 11, 2007

(54) THERMAL MANAGEMENT SYSTEM AND METHOD FOR A HEAT PRODUCING SYSTEM

(75) Inventors: David J. Allen, Gladstone, MI (US); Mark S. Bader, Gladstone, MI (US); Michael W. Martin, Gladstone, MI (US); Robert D. Chalgren, Marquette, MI (US); Michael P. Lasecki, Gladstone, MI (US); Thomas J. Hollis, Medford, NJ (US)

(73) Assignee: EMP Advanced Development, LLC, Escanaba, MI (US)

( * ) Notice: Subject to any disclaimer, the term of this patent is extended or adjusted under 35 U.S.C. 154(b) by 347 days.

(21) Appl. No.: 11/063,366

(22) Filed: Feb. 23, 2005

(65) Prior Publication Data

US 2006/0185626 A1 Aug. 24, 2006

(51) Int. Cl.
*F01P 5/10* (2006.01)

(52) U.S. Cl. ..... 123/41.44; 123/568.12

(58) Field of Classification Search ..... 123/41.44, 123/41.12, 41.31, 568.12
See application file for complete search history.

(56) References Cited

U.S. PATENT DOCUMENTS 3,232,044 A 2/1966 Gratzmuller
3,397,684 A 8/1968 Scherenberg
3,444,845 A 5/1969 Scheiterlein
3,797,562 A 3/1974 Brille et al.
3,934,644 A 1/1976 Johnston
4,077,219 A 3/1978 Melchior et al.
4,317,439 A 3/1982 Emmerling
4,977,743 A 12/1990 Aihara et al.
5,036,803 A * 8/1991 Nolting et al. ..... 123/41.1
5,215,044 A * 6/1993 Banzhaf et al. ..... 123/41.29
5,440,880 A 8/1995 Ceynow et al.
5,607,010 A 3/1997 Schönfeld et al.
5,611,202 A 3/1997 Sumser et al.
5,732,688 A 3/1998 Charlton et al.
5,927,075 A 7/1999 Khair
6,098,576 A 8/2000 Nowak, Jr. et al.
6,244,256 B1 6/2001 Wall et al.
6,321,697 B1 11/2001 Matsuda et al.

(Continued)

OTHER PUBLICATIONS

Robert D. Chalgren Jr. et al.; "A Controllable Water Cooled Charge Air Cooler (WCCAC) for Diesel Trucks"; 2004-01-2614; 2004 SAE International; 8 pages.
Robert D. Chalgren Jr. et al.; "Development and Verification of a Heavy Duty 42/14V Electric Powertrain Cooling System"; 2003-01-3416; 2003 SAE International; 9 pages.
Robert D. Chalgren et al.; "A Controlled EGR Cooling System for Heavy Duty Diesel Applications Using the Vehicle Engine Cooling System Simulation"; 2002-01-0076; 2002 Society of Automotive Engineers, Inc.; pp. 1-26.
Robert D. Chalgren Jr. et al.; "Thermal Comfort and Engine Warm-up Optimization of a Low-Flow Advanced Thermal Management System"; 2004-01-0047; 2004 SAE International; 7 pages.
David J. Allen, et al.; "Thermal Management Evolution and Controlled Coolant Flow"; 2001-01-1732; 2001 Society of Automotive Engineers, Inc.; pp. 1-18.

*Primary Examiner*—Stephen K. Cronin
*Assistant Examiner*—Katrina Harris
(74) *Attorney, Agent, or Firm*—Brooks Kushman P.C.

(57) ABSTRACT

A vehicle thermal management system includes a temperature control fluid for controlling the temperature of at least a portion of a vehicle system. A pump is configured to pump the temperature control fluid through a heat exchanger to facilitate the transfer of heat between the temperature control fluid and ambient air. A fan is operable to move the ambient air across the heat exchanger to facilitate increased heat transfer. A control system is used to control operation of the pump and the fan. The control system is provided with operation data that includes optimized operating speeds for the pump and the fan to minimize power consumption, while maximizing heat transfer.

23 Claims, 7 Drawing Sheets

U.S. PATENT DOCUMENTS

| | | | |
|---|---|---|---|
| 6,357,541 | B1 | 3/2002 | Matsuda et al. |
| 6,422,309 | B2 | 7/2002 | Vincent |
| 6,772,715 | B2 | 8/2004 | Pfeffinger et al. |
| 6,786,210 | B2 | 9/2004 | Kennedy et al. |
| 6,789,512 | B2 | 9/2004 | Duvinage et al. |
| 6,834,645 | B2 | 12/2004 | Takizawa et al. |
| 6,836,710 | B2 | 12/2004 | Yamaki |
| 2002/0174840 | A1 | 11/2002 | Luckner et al. |
| 2003/0150406 | A1 | 8/2003 | Takagi et al. |
| 2004/0244782 | A1 | 12/2004 | Lewallen |
| 2005/0028756 | A1 | 2/2005 | Santanam et al. |

* cited by examiner

THERMAL MANAGEMENT SYSTEM AND METHOD FOR A HEAT PRODUCING SYSTEM

BACKGROUND OF THE INVENTION

1. Field of the Invention

The present invention relates to a thermal management system, and a method for managing thermal characteristics, for a heat producing system.

2. Background Art

In response to demands for improved fuel economy and reduced emissions, vehicles today are being manufactured with systems designed to increase combustion efficiency and reduce parasitic losses of various vehicle components. One way to increase combustion efficiency in an internal combustion engine is to maintain a high degree of control over the temperature of the combustion in the engine cylinders. The use of an effective vehicle thermal management system can help to achieve this goal. For example, controlling one or more of the engine oil temperature, the engine coolant temperature, and the intake air temperature, can provide an effective means for ensuring that combustion within the engine cylinders takes place within a desired temperature range. Controlling the temperature of the combustion within the engine can help to increase combustion efficiency, and reduce exhaust emissions.

A number of thermal management systems are described in a Society of Automotive Engineers (SAE) Technical Paper, Document Number 2001-01-1732, entitled "Thermal Management Evolution and Controlled Coolant Flow," copyright 2001. One such system includes a controllable electric pump for circulating engine coolant through an EGR cooler. The electric pump can replace a larger, mechanical pump, thereby providing an overall space savings. Another system described in the SAE paper includes a separate EGR cooling loop having its own coolant loop separate from the engine coolant loop. The EGR cooling loop includes a controllable electric pump, and its own liquid-to-air heat exchanger for dissipating heat from the EGR coolant.

While a vehicle thermal management system can be used to control the temperatures of various vehicle systems, including the temperature of combustion, it would be desirable if the same thermal management system could be used to decrease parasitic losses of various components within the vehicle. For example, a thermal management system may employ the use of one or more electric fluid pumps, electric valves and electric fans. These electric components may replace one or more mechanical components which typically operate in accordance with the speed of the engine. Through the use of electric components, controlled by an electronic controller, it would be desirable if such a thermal management system could optimize the operation of the components to reduce overall power consumption while still providing the functionality necessary for an efficient thermal management system.

SUMMARY OF THE INVENTION

Accordingly, one aspect of the present invention includes a vehicle thermal management system operable to maintain the temperature of combustion within the engine at or near a target temperature, thereby providing increased combustion efficiency.

Another aspect of the invention provides one or more electric components as part of a thermal management system controlled by an electronic control system at optimized levels, thereby reducing power consumption.

The invention also provides a thermal management system for a heat producing system that includes a first temperature control fluid for controlling the temperature of a least a portion of the heat producing system. A first temperature sensor senses a temperature of the first temperature control fluid, and outputs a signal related to the temperature of the first temperature control fluid. A first heat exchanger transfers heat between the first temperature control fluid and ambient air. A second temperature sensor senses a temperature of the ambient air and outputs a signal related to the temperature of the ambient air. A variable speed electric fan is operable to move the ambient air across the first heat exchanger. A variable speed electric pump is operable to pump the first temperature control fluid through the first heat exchanger. A control system is operatively connected to the temperature sensors, the fan and the pump, and includes at least one controller. The control system is programmed with operation data providing optimized operating speeds for combined operation of the fan and the pump. Each of the optimized operating speeds correspond to an amount of heat transfer between the first temperature control fluid and the ambient air via the first heat exchanger at a respective ambient air temperature. Further, each of the optimized operating speeds provide a minimized combined power input into the fan and the pump for the corresponding amount of heat transfer. The control system is configured to operate the fan and the pump at the optimized operating speeds based at least in part on the operation data and signals received from the temperature sensors.

The invention further provides a method for managing thermal characteristics of a heat producing system. The heat producing system includes a first temperature control loop, which includes a first temperature control fluid for controlling the temperature of at least a portion of the heat producing system. A first heat exchanger transfers heat between the first temperature control fluid and ambient air. A first fan moves the ambient air across the first heat exchanger, and a first pump pumps the first temperature control fluid through the first heat exchanger. The method includes determining coefficients of performance for combined operation of the first fan and the first pump. Each of the coefficients of performance is defined as a ratio of the amount of heat transfer between the first temperature control fluid and the ambient air via the first heat exchanger during operation of at least one of the first fan and the first pump to the combined power input into the first fan and the first pump at a respective ambient air temperature. A temperature of the first temperature control fluid is determined, as is a temperature of the ambient air. The temperature of the first temperature control fluid is compared to a first target temperature. At least one of the first fan and the first pump are operated based at least in part on the coefficients of performance and the comparison of the temperature of the first temperature control fluid to the first target temperature.

The invention also provides a thermal management system for a heat producing system. The heat producing system includes an engine and a transmission in a vehicle, the transmission containing transmission oil. The thermal management system includes a transmission temperature control loop for controlling a temperature of the transmission. The transmission temperature control loop includes a first pump operable to pump a first temperature control fluid through the transmission temperature control loop. A first radiator transfers heat between the first temperature control fluid and ambient air. A first fan is operable to move the ambient air across the first radiator. A first valve is operable to control the amount of the first temperature control fluid passing through the first radiator. A heat exchanger is in fluid communication with the first radiator, and transfers heat between the first temperature control fluid and the transmission oil. The thermal management system also includes an engine temperature control loop for controlling a temperature of the engine. The engine temperature control loop includes a second pump operable to pump a second temperature control fluid through the engine temperature control loop. A second radiator transfers heat between the second temperature control fluid and the ambient air. A second fan is operable to move the ambient air across the second radiator, and a second valve is operable to control the amount of the second temperature control fluid passing through the second radiator. A first conduit is disposed between the engine temperature control loop and the first valve. The first valve is further operable to facilitate mixing of the first and second temperature control fluids. A second conduit is disposed between the engine temperature control loop and the transmission temperature control loop. A third valve is operable to control flow through the second conduit, thereby facilitating mixing of the first and second temperature control fluids. A control system, including at least one controller, is configured to operate at least the first fan, the first pump, and the first and third valves.

The invention further provides a thermal management system for a heat producing system. The heat producing system includes an engine and a transmission in a vehicle, the transmission containing transmission oil. The thermal management system includes a transmission temperature control loop for controlling a temperature of the transmission. The transmission temperature control loop includes a first pump which is operable to pump a first temperature control fluid through a first radiator which transfers heat between the first temperature control fluid and ambient air. A first fan is operable to move the ambient air across the first radiator, and a first valve is operable to control the amount of the first temperature control fluid passing through the first radiator. A first heat exchanger is in fluid communication with the first radiator, and transfers heat between the first temperature control fluid and the transmission oil. An engine control loop is used for controlling a temperature of the engine, and includes a second pump operable to pump a second temperature control fluid through the engine temperature control loop. A second radiator transfers heat between the second temperature control fluid and the ambient air. A second fan is operable to move the ambient air across the second radiator, and a second valve is operable to control the amount of the second temperature control fluid passing through the second radiator. A second heat exchanger is in fluid communication with the first and second radiators, and transfers heat between the first temperature control fluid and the second temperature control fluid. A control system, including at least one controller, is configured to operate at least the first fan and the first valve.

The invention also provides a thermal management system for a heat producing system. The thermal management system includes a first temperature control fluid for circulating through a portion of the heat producing system including an inlet side and an outlet side. A first temperature sensor is disposed on the outlet side for sensing an outlet temperature of the first temperature control fluid, and for outputting a signal related to the outlet temperature. A second temperature sensor is disposed on the inlet side for sensing an inlet temperature of the first temperature control fluid, and for outputting a signal related to the sensed inlet temperature. A first heat exchanger transfers heat between the first temperature control fluid and ambient air. A first valve is disposed upstream from the first heat exchanger, and is operable to prohibit at least some of the first temperature control fluid from passing through the first heat exchanger. A first fan is operable to move the ambient air across the first heat exchanger. The first fan is a variable speed electric fan. A first pump is operable to pump the first temperature control fluid through the portion of the heat producing system and through the first heat exchanger. A control system is operatively connected to the temperature sensors and the first fan, and includes at least one controller. The control system is configured to control the outlet temperature by controlling operation of at least the valve independent of controlling the fan, and is further configured to control the inlet temperature by controlling operation of the fan independent of controlling the valve.

DETAILED DESCRIPTION OF THE PREFERRED EMBODIMENT(S)

Figure 1:
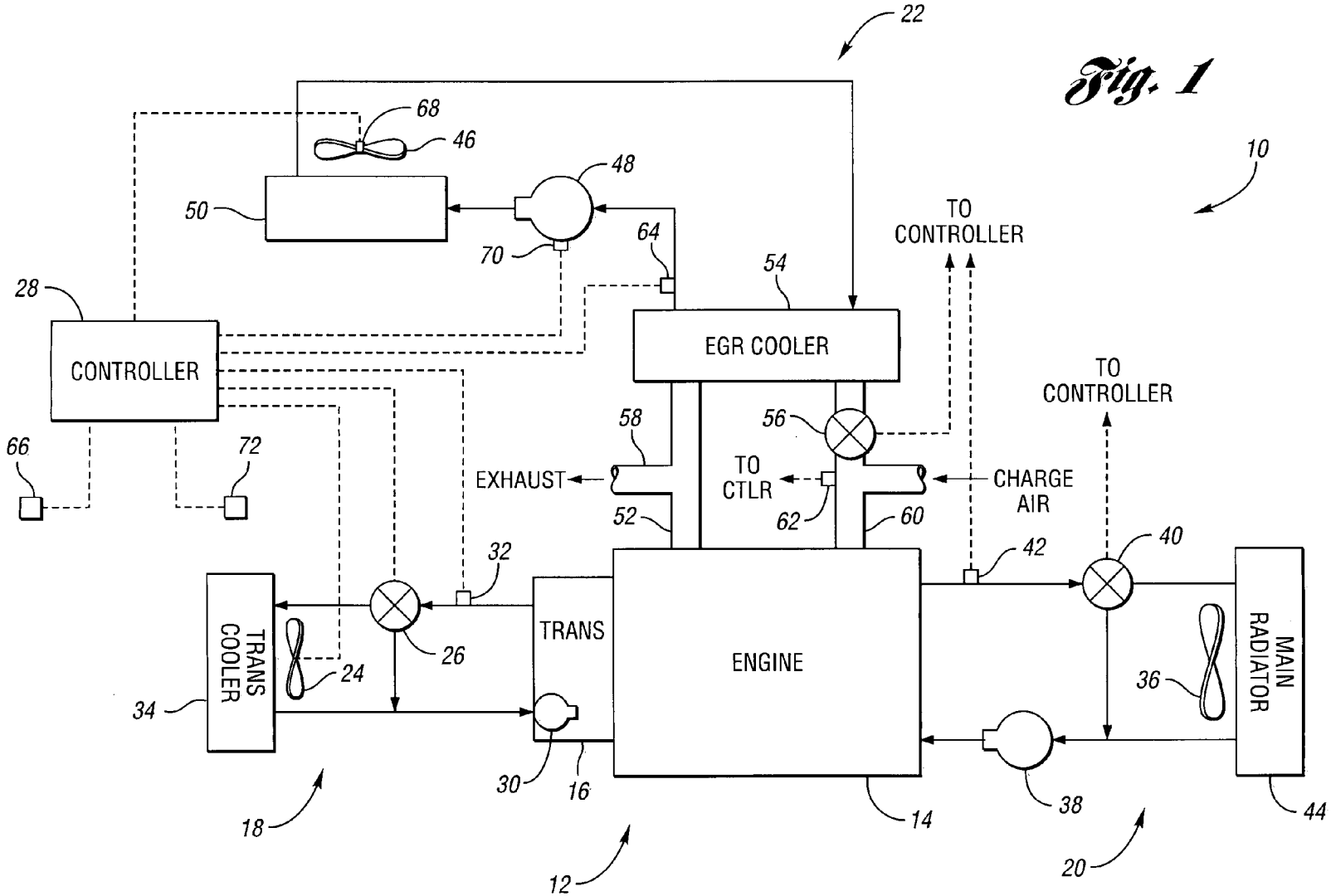
FIG. 1 is a schematic representation of a vehicle thermal management system in accordance with the present invention.

FIG. 1 shows a thermal management system 10 for a vehicle, a portion of which is shown generally at 12, and includes an engine 14 and a transmission 16. The thermal management system 10 includes three temperature control loops, a transmission temperature control loop 18, an engine temperature control loop 20, and an exhaust gas recirculation (EGR) temperature control loop 22. It is understood that a thermal management system in accordance with the present invention can contain fewer than three, or more than three temperature control loops. The transmission temperature control loop 18 includes an electric fan 24 and an electric valve 26. The fan 24 and the valve 26 are controlled by a controller system, represented in FIG. 1 by a single controller 28. It is understood that a control system may include a number of controllers that may communicate with each other via a communications network, such as a controller area network (CAN). Although the thermal management system 10 is shown in FIG. 1 in conjunction with a vehicle, a thermal management system in accordance with the present invention may be used with various heat producing systems, such as fuel cells, which may or may not be part of a vehicle. A thermal management system in accordance with the present invention may also be used, for example with stationary systems, such as electrical generation systems.

The transmission 16 includes a pump 30 that pumps the transmission oil through the temperature control loop 18. The pump 30 is shown inside the transmission 16, but it is understood that it can be located outside the transmission 16. Further, the pump 30 can be electric, or it can be mechanically driven. A temperature sensor 32 senses the temperature of the transmission oil as it leaves the transmission 16, and conveys a signal related to the sensed temperature to the controller 28. When the transmission oil requires cooling, the controller 28 can command the valve 26 to allow at least some of the transmission oil to circulate through a heat exchanger, or transmission oil cooler 34. The controller 28 can also operate the fan 24 to provide more or less air across the transmission oil cooler 34, thereby affecting the amount of heat transfer between the transmission oil and the ambient air. When the transmission oil is cold, however, the controller 28 may control the valve 26 such that the transmission oil bypasses the transmission oil cooler 34 and returns to the transmission 16. This allows the transmission oil to warm up more quickly.

The engine temperature control loop 20 includes a fan 36 and a pump 38. In the embodiment shown in FIG. 1, the fan 36 and the pump 38 are mechanical components, driven by the engine 14. It is understood, however, that an electric fan and/or an electric pump could be used in place of the mechanical components. Similarly, an electric valve 40, which is controlled by the controller 28, could be a mechanically actuated thermostat. A temperature sensor 42 senses the temperature of the engine coolant, and sends a signal to the controller 28 related to the sensed temperature. As with the transmission temperature control loop 18, the engine temperature control loop 20 includes a heat exchanger, or radiator 44. Based on the sensed temperature of the engine coolant, the controller 28 can command the valve 40 to allow some or all of the engine coolant to pass through the radiator 44, thereby facilitating heat exchange from the engine coolant to the ambient air. Conversely, the controller 28 can command the valve 40 into a full bypass position, such that all of the engine coolant bypasses the radiator 44, and is pumped back into the engine. This is particularly useful just after engine startup, before the engine 14 has reached a desired operating temperature.

The EGR temperature control loop 22 includes an electric fan 46 and an electric pump 48, both of which are controlled by the controller 28. The pump 48 is operable to pump a temperature control fluid, such as a coolant, through a heat exchanger 50 so that heat can be transferred between the EGR coolant and the ambient air. The EGR temperature control loop 22 is configured to control the temperature of engine exhaust gas that is recirculated back into the engine 14. In particular, exhaust gas leaves the engine via an exhaust manifold 52. At least a portion of the exhaust gas goes through another heat exchanger, or EGR cooler 54.

In the EGR cooler 54, heat is transferred between the exhaust gas and the EGR coolant. The amount of exhaust gas that goes through the EGR cooler 54 is controlled by an EGR valve 56. Unlike many EGR cooling systems, the EGR valve 56 is on the exit side of the EGR cooler 54. This helps to increase the life of the EGR valve 56, because the temperature of the exhaust gas entering the EGR valve 56 is significantly lower on the exit side of the EGR cooler 54 then it is on the entrance side. That portion of the exhaust gas that does not go through the EGR cooler 54 is exhausted via an exhaust pipe 58. The exhaust pipe 58 may lead directly to a catalyst, or some other emission control device, or alternatively, it may lead to a turbine that is used to operate a compressor, for example, if the vehicle 12 is equipped with a turbo charger.

Downstream from the EGR valve 56, the charge air (C.A.) enters the intake manifold 60. Here, it mixes with the exhaust gas before entering the combustion chambers of the engine 14. If the vehicle 12 is equipped with a turbo charger, a charge air cooler (C.A.C.) can be provided such that the temperature of the exhaust gas and the temperature of the charge air entering the intake manifold 60 is approximately the same. This allows for increased control over the temperature of the air entering the combustion chambers of the engine 14. Control of this temperature is desirable for optimizing the efficiency of the combustion in the engine 14.

A temperature sensor 62 is located in the intake manifold 60, for sensing the temperature of the air as it enters the engine 14. The sensor 62 is in communication with the controller 28, and sends signals to the controller 28 related to the intake air temperature. As described in detail below, the controller 28 uses the signal from the sensor 62, along with other signals, to control the fan 46 and the pump 48 to help ensure that the exhaust gas leaving the EGR cooler 54 is at or near a desired temperature.

In addition to the temperature sensor 62, temperature sensors 64 and 66 are also in communication with the controller 28. The temperature sensor 64 senses the temperature of the EGR coolant as it leaves the EGR cooler 54. The temperature sensor 66 senses the temperature of the ambient air. This temperature can be used to help determine how much heat will be exchanged between the various heat exchangers in the thermal management system 10 and the ambient air. Also shown in FIG. 1, the fan 46 and the pump 48 have speed sensors 68, 70, each of which is in communication with the controller 28. It is understood that other components of the thermal management system 10, such as the electric fan 24, may also include one or more speed sensors, to help the controller 28 better control their operation. It is worth noting that speed sensors, for example, the sensors 68, 70, may measure rotational speed directly, such as from an output shaft. Alternatively, such sensors could determine or estimate speeds by monitoring electric fields within the motor of the corresponding fan, pump, or other component.

In order to optimize operation of the various components of the thermal management system 10, the controller 28 is programmed with operation data which provides optimized operating speeds for the various components. To illustrate this, the EGR temperature control loop 22 will be used as an example; however, it is understood that other temperature control loops could be similarly configured. If, for example, it is desired to maintain the temperature of the intake air entering the engine 14 at or near some predetermined temperature, it may be necessary to provide more or less heat transfer between the exhaust gas and the EGR coolant in the EGR cooler 54. For example, a temperature of approximately 55° C. has been found to provide highly efficient combustion in an engine, such as the engine 14.

This leads to reduced fuel consumption, as well as reduced exhaust emissions. In order to help ensure that the air entering the engine 14 is at or near 55° C., the temperature of the EGR coolant is controlled by the controller 28. The temperature of the EGR coolant can be controlled by the amount of coolant flowing through the heat exchanger 50, which is controlled by the speed of the pump 48. The temperature of the EGR coolant can also be controlled by the speed of the fan 46. Because operation of components, such as the fan 46 and the pump 48 consume power, it is desirable to minimize that power consumption for any given amount of desired heat transfer.

In order to optimize operation of the fan 46 and the pump 48, the controller 28 is programmed with operation data that provides optimized operating speeds for the combined operation of the fan 46 and the pump 48. Each of these optimized operating speeds corresponds to an amount of heat transfer between the EGR coolant and the ambient air via the heat exchanger 50 at a given ambient air temperature. Each of the optimized operating speeds provide a minimized combined power input into the fan 46 and the pump 48 for the corresponding amount of heat transfer. Based at least in part on inputs from the temperature sensors 62, 64, 66, and the speed sensors 68, 70, the controller 28 uses the operation data to operate the fan 46 and the pump 48 to provide the desired amount of heat transfer between the EGR coolant and the ambient air, while minimizing the power consumption by the fan 46 and the pump 48.

The operation data programmed into the controller 28 can be stored in any of a number of different forms. For example, the controller 28 can be programmed with a lookup table that contains the relationship between the speed of the fan 46, the speed of the pump 48, and a given amount of heat rejection. Alternatively, the operation data can include at least one equation which defines an optimization curve, wherein either the speed of the fan 46 is a function of the speed of the pump 48 ($\omega_f=f(\omega_p)$), or the speed of the pump 48 is a function of the speed of the fan 46 ($\omega_p=f(\omega_f)$).

Figure 2:
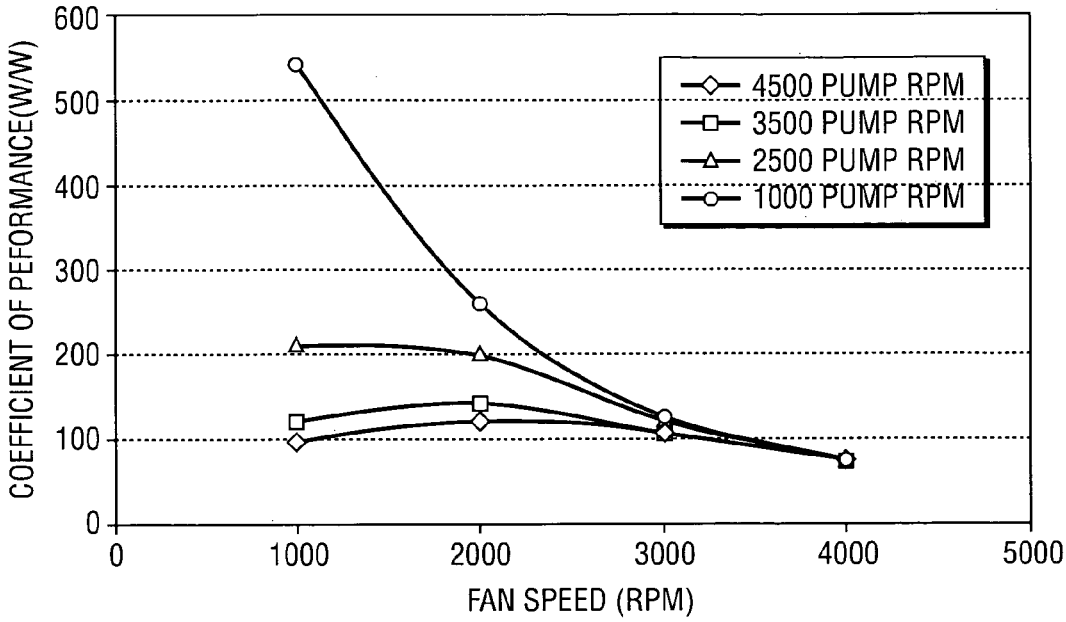
FIG. 2 is graph showing coefficients of performance for different speeds of a pump and a fan shown in FIG. 1.
Figure 3:
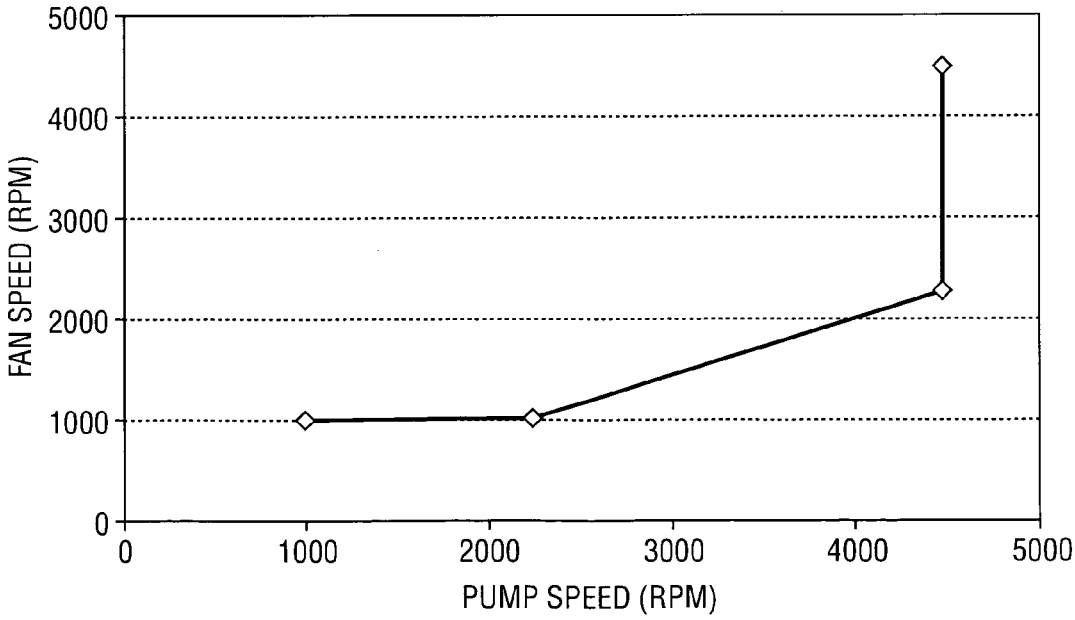
FIG. 3 is a graph showing maximum coefficients of performance derived from FIG. 2.

The operation data that is programmed into the controller 28 can be determined by any method effective to provide the necessary data for minimizing power consumption while maximizing heat transfer. For example, bench testing can be performed on a temperature control loop using the same or similar components to those in an actual temperature control loop, such as the EGR temperature control 22. One method of obtaining operation data is illustrated in FIGS. 2 and 3. In FIG. 2, coefficients of performance have been determined for the combined operation of the fan 46 and the pump 48. The coefficients of performance are defined as a ratio of heat rejection to power consumption. Specifically, the heat rejection represents the amount of heat transferred between the EGR coolant and the ambient air via the heat exchanger 50 during operation of at least one of the fan 46 and the pump 48. The power consumption represents the combined power input into the fan 46 and the pump 48. Of course, the amount of heat rejection also depends on the temperature of the ambient air.

FIG. 2 shows the coefficient of performance (COP) in watts per watt (w/w) versus fan speed in revolutions per minute (rpm). Each of the curves shown in the graph in FIG. 2 represent a different pump speed. Using the information from FIG. 2, maximum coefficients of performance for corresponding operating speeds of the fan 46 and the pump 48 are readily determined, and plotted in FIG. 3. For example, for any given pump speed, a fan speed can be determined that corresponds to the maximum COP. In FIG. 2 it is shown that for a pump speed of 1,000 rpm and 2,500 rpm, the maximum COP occurs at a fan speed of 1,000 rpm. Conversely, for a pump speed of 3,500 rpm or 4,500 rpm, the maximum coefficient of performance occurs when the fan speed is approximately 2,000 rpm, or slightly above. Thus, the graph in FIG. 3 shows that the maximum COP is initially obtained by keeping the fan speed at 1,000 rpm, until the pump speed exceeds 2,000 rpm. A linear approximation is then used as the speed of the pump increases to 4,500 rpm. It is worth noting that the graph in FIG. 3 continues to rise after the speed of the pump has reached 4,500 rpm, because although 4,500 rpm is the maximum pump speed, additional heat rejection can be obtained by increasing the speed of the fan.

Figure 4:
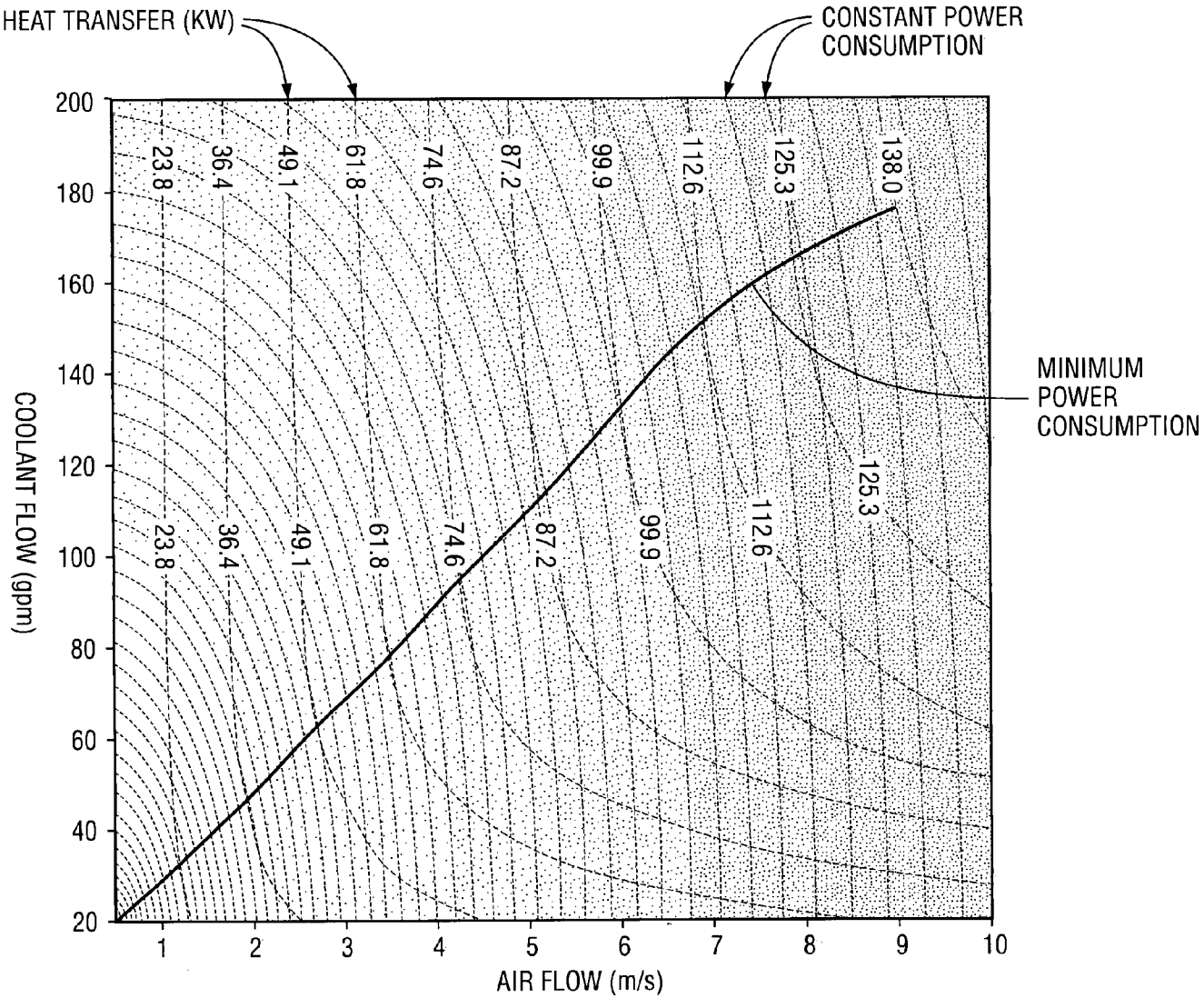
FIG. 4 is a graph showing a line of minimum power consumption for various pump and fan speeds.

An alternative way of providing the operation data is shown in FIG. 4. Along the abscissa is the airflow of a fan, such as the fan 46 shown in FIG. 1. The airflow, which is in meters per second (m/s) is directly related to the fan speed. Similarly, along the ordinate is the flow, in gallons per minute (gpm), of the EGR coolant. The coolant flow is directly related to the speed of the pump 48, and therefore, although flow rates are used on the graph shown in FIG. 4, the fan speed and pump speed could also be used.

Also shown in FIG. 4 are lines of constant heat transfer and lines of constant power consumption. In the case of the power consumption lines, they represent the combined power input into the fan 46 and the pump 48. At certain points in the graph, the lines of constant heat transfer and constant power consumption become very nearly parallel. It is at these points that the minimum power consumption occurs. Thus, FIG. 4 shows a line connecting the points where the heat transfer and power consumption lines are parallel. This is a line of minimum power consumption, and so for any given amount of heat transfer, this line represents the maximum coefficient of performance.

In practice, the controller 28 uses the operation data to optimize the operating speeds of the fan 46 and the pump 48. One method of optimizing these speeds includes comparing the temperature of the EGR coolant, for example as measured by the sensor 64, to a first target temperature. This target temperature can be calculated based on any number of parameters, such as the size of the EGR cooler 54, the temperature of the exhaust gas entering the EGR cooler 54, and the amount of exhaust gas flowing through the EGR cooler 54. The difference between the temperature of the EGR coolant and the target temperature defines a temperature error. In order to maintain the temperature of the intake air entering the engine 14, it is desirable to reduce this temperature error, so as to drive the temperature of the EGR coolant toward the target temperature. To accomplish this, the controller 28 determines the temperature error, which includes both a magnitude and a sign. Based on the magnitude and sign of the temperature error, the controller 28 uses the operation data, for example such as the data shown in FIG. 4, to operate the fan 46 and the pump 48 accordingly.

To determine an appropriate change in operating speed for either or both of the fan 46 and the pump 48, the controller 28 may first determine a current operating point based on at least one of the speed of the fan 46 and the speed of the pump 48. For example, if both speeds are used, a current operating point can be easily located on a graph, such as the graph shown in FIG. 4. Conversely, if only one of the speeds is used to determine the current operating point, it could be assumed that the chosen operating speed is located along the line of minimum power consumption, and in this way the current operating point could also be located on the graph shown in FIG. 4. Once the current operating point is located, the temperature error is used to determine if more or less cooling is needed (based on the sign of the temperature error), and how much cooling should be added or taken away (based on the magnitude of the temperature error). The new operating point is then located along the line of minimum power consumption.

In addition to the types of operation data described above, the operation data programmed into the controller 28 may also include allowance for the speed of the vehicle. For example, if a thermal management system, such as the thermal management system 10, is used in a large piece of construction equipment, which always moves at a very slow speed, the vehicle speed may not need to be considered in the operation data. If, however, a thermal management system is used in a vehicle such as a car or a truck, which may reach relatively high speeds, the operation data can factor in the effect of the vehicle speed on the optimized operating speed of the pump and fan. Again using the EGR temperature control loop 22 as an example, it may be possible to reduce the fan speed as the speed of the vehicle increases. Of course, this will depend on such factors as the size and location of the heat exchanger 50. Generally, as the speed of the vehicle increases, the amount of RAM airflow will also increase. This may reduce the need to operate the fan 46, thus further reducing power consumption.

In order to include an allowance for vehicle speed, the controller 28 need only receive an input related to the vehicle speed. For example, the temperature sensor 66 could form a portion of a hot wire anenometer, which would provide not only the ambient air temperature, but also a measure of air flow. The measured air flow would be related to the vehicle speed, and thus, the controller 28 could use this input for the vehicle speed allowance. Similarly, intake air pressure may also be related to the vehicle speed, and could therefore be an input into the controller 28. Of course, an actual vehicle speed measurement could also be used as an input.

Although it may be desirable to optimize the operation of the various components of the thermal management system 10, it may also be desirable to quickly drive the temperature of a temperature control fluid toward a target temperature. Therefore, the controller 28 may also be configured to effect transient operation of various components in order to quickly change the temperature of a temperature control fluid. For example, as shown in FIG. 1, the thermal management system 10 includes a load sensor 72. The load sensor is used to sense the load on the engine 14, and to output signals to the controller 28 related to the engine load. The sensor 72 can, for example, be an accelerator pedal position sensor, or a fuel flow rate sensor, which indicates engine load based on driver demand. In the case of a spark ignition engine, the sensor 72 may be a throttle position sensor or a mass airflow sensor. In order to quickly respond to changes in engine load, the controller 28 can be configured to increase or decrease one or both of the fan speed and pump speed immediately upon sensing a change in engine load. This allows the thermal management system 10 to rapidly start driving the temperature of, for example the EGR coolant, toward its target temperature. The controller 28 can be programmed such that the transient operation occurs for some short period of time, perhaps milliseconds, before the operation data is used to optimize the speeds of the fan 46 and the pump 48.

Figure 5:
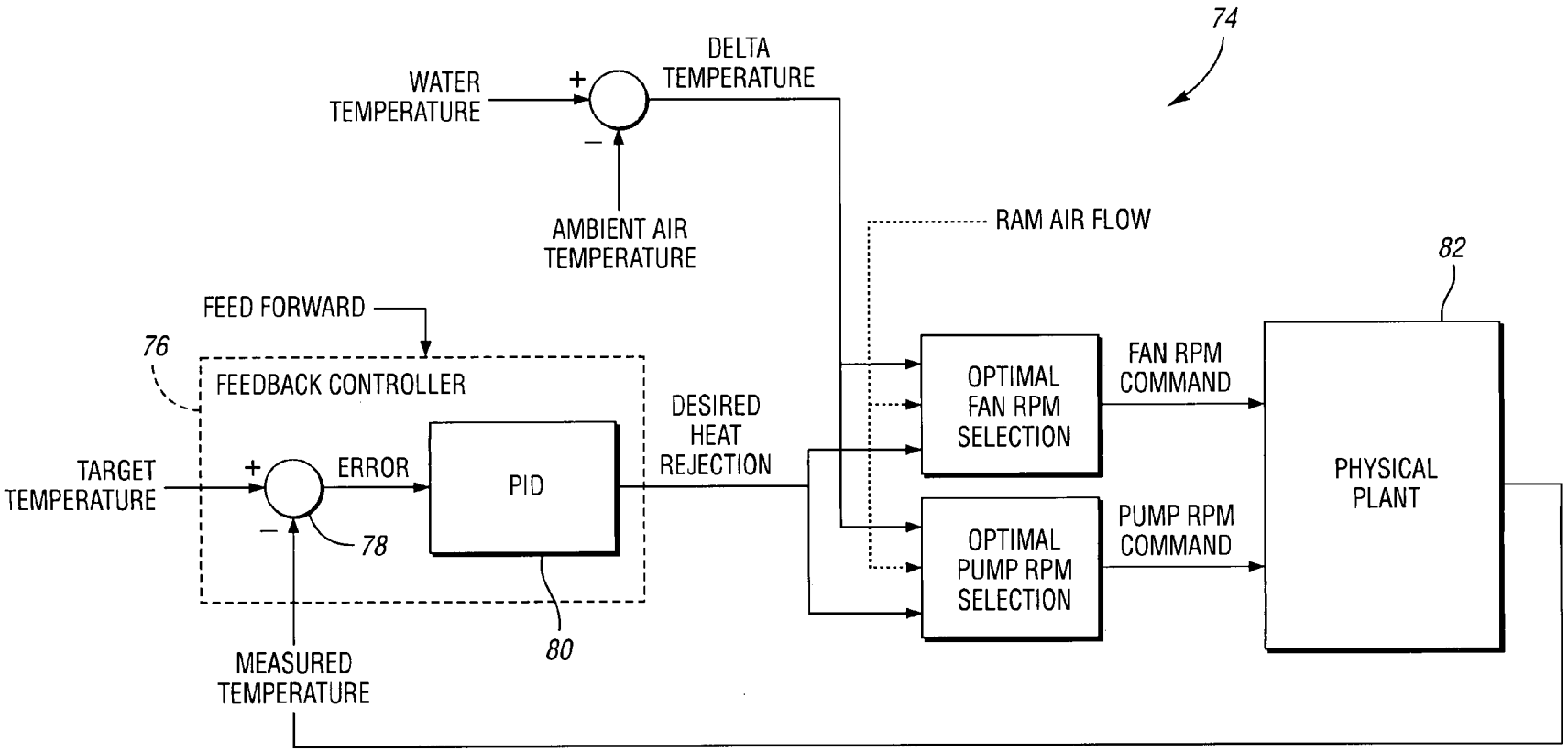
FIG. 5 is a control diagram illustrating a control system used in accordance with the present invention.

As described above, the controller 28 represents a control system, which may include one or more hardware controllers, software controllers, or some combination thereof. FIG. 5 shows a control system 74 that can be used in accordance with the present invention. The control system 74 includes a feedback controller 76 that receives inputs such as a target coolant temperature, and a measured coolant temperature. These two values are subtracted at a summing junction 78, and a subsequent temperature error is fed into a proportional integral derivative (PID) controller 80. In addition to the temperature inputs, the feedback controller 76 may also receive some feedforward information from other vehicle systems. Based on these various inputs, the PID controller 80 outputs a desired heat rejection. The temperature of the coolant is also compared to the ambient air temperature, and the difference between them—shown as "Delta Temperature" in FIG. 5—is calculated. For vehicles where the vehicle speed may be a factor, the RAM airflow is also considered. Each of these values is then used to select an optimal fan and optimal pump speed. The fan and pump speeds are then sent to the appropriate system components, represented in FIG. 5 by the physical plant 82.

Figure 6:
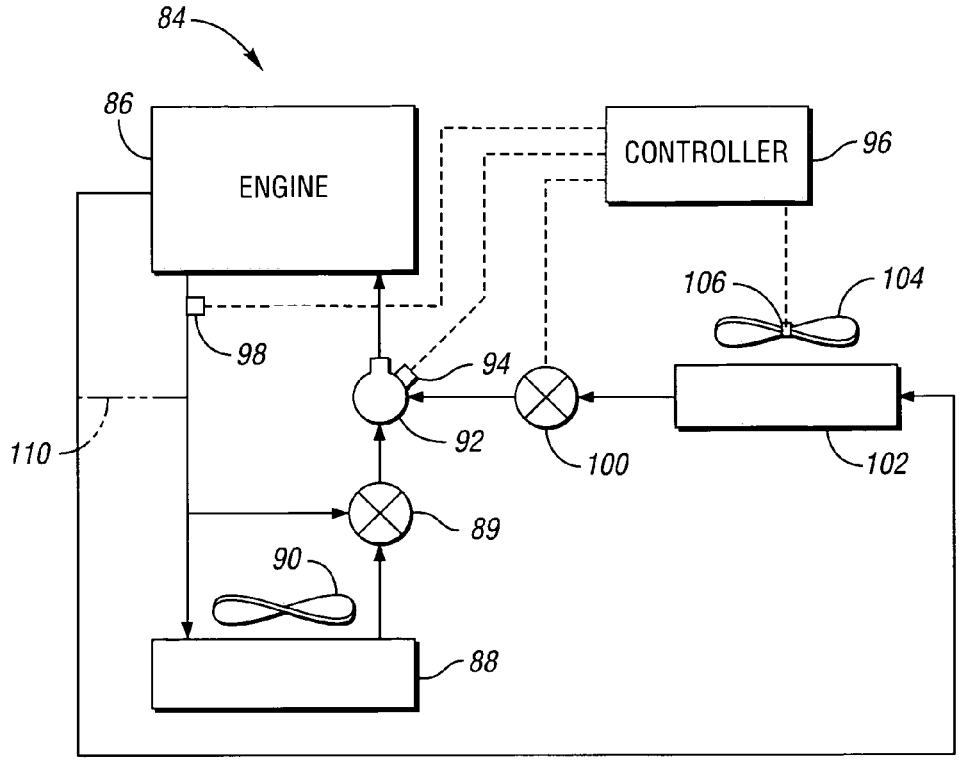
FIG. 6 is a schematic representation of a second vehicle thermal management system in accordance with the present invention.

It is worth noting that the vehicle thermal management system shown in FIG. 1 represents only one of many different thermal management systems in accordance with the present invention. For example, FIG. 6 shows an alternative vehicle thermal management system that can be used to provide extra cooling to an engine 86, which may be subject to heavy thermal load conditions. The thermal management system 84 includes a conventional heat exchanger, or radiator 88. The radiator 88 provides the primary cooling for the engine 86. A bypass valve 89, which can be thermostatic or electrically controlled, allows some or all of the coolant to bypass the radiator 88 during startup and cold weather conditions.

A fan 90 is operable to facilitate airflow across the radiator 88. As shown in FIG. 6, the fan 90 is engine driven, although an electric fan could be used, thereby providing greater speed control. The thermal management system 84 includes a pump 92 having a speed sensor 94. As shown in FIG. 6, the pump 92 is electric, and is controlled by a controller 96. In some applications, it may be desirable to use a mechanical pump instead of the electric pump 92; however, this would necessarily alter the optimizing control scheme described below.

A temperature sensor 98 senses the temperature of the engine coolant and sends signals to the controller 96 related to the temperature of the coolant. When the engine 86 is subject to very high thermal loads, the radiator 88 may not be able to dissipate enough heat from the engine coolant to the ambient air to maintain a desired engine temperature. In such cases, when the temperature sensed by the sensor 98 is too high, the controller 96 will increase the speed of the pump 92, and/or open an electric valve 100 to allow coolant to pass through another heat exchanger, or second radiator 102. It is worth noting that the valve 100 and the bypass valve 89 could be replaced by a single valve. This would have the benefit of eliminating one valve from the system 84, though control of the single valve may be somewhat more complex. The amount of coolant flowing through the second radiator 102 is dependent the inputs received by the controller 96. In addition, the controller 96 controls operation of the fan 104, and receives speed information from a speed sensor 106. Optionally, a conduit 110 can connect the inputs to the first and second radiators 88, 102, thereby facilitating the flow of engine coolant between them. As with the embodiment described in FIG. 1, the controller 96 may be programmed with operation data and configured to operate the fan 104 and the pump 92 in accordance with optimized operation data.

In addition to the fan 104 and the pump 92, the controller also controls the electric valve 100. The operation of the valve 100 can also be optimized to reduce total power consumption. For example, when the engine coolant is below a first temperature set point, the valve 100 may be complete closed such that the pump 92 pumps all of the engine coolant through the radiator 88. During this time, the pump 92 is operated at a first predetermined speed, which will generally be a minimum desired pump speed. Once the engine coolant reaches the first temperature set point, the controller 96 commands the valve 100 to at least partially open, such that some of the engine coolant passes through the second radiator 102. If the cooling achieved by opening the valve 100 is still not enough, the speed of the pump 92 can be increased to one of the optimized operating speeds when the engine coolant reaches a second temperature set point. The second temperature set point may be set 2.5°-4° C. higher than the first temperature set point. This minimizes interaction between the valve 100 and the pump 92, and allows the pump 92 to run at the minimum speed, thereby minimizing power consumption, until higher flow is required for the engine cooling.

In order to further optimize operation of the components of the thermal management system 84, the controller 96 can be configured to prohibit operation of the fan 104 until the pump 92 reaches a second predetermined speed. In general, operation of a fan, such as the fan 104, will consume more power than operation of a pump, such as the pump 92. Therefore, the speed of the pump 92 is increased to increase heat transfer from the engine coolant, until the speed of the pump 92 reaches some predetermined level. After the speed of the pump 92 reaches this predetermined level, the speed of the fan can be set to one of the optimized speeds based on the current operating point, and in particular, based on the speed of the pump 92.

Figure 6A:
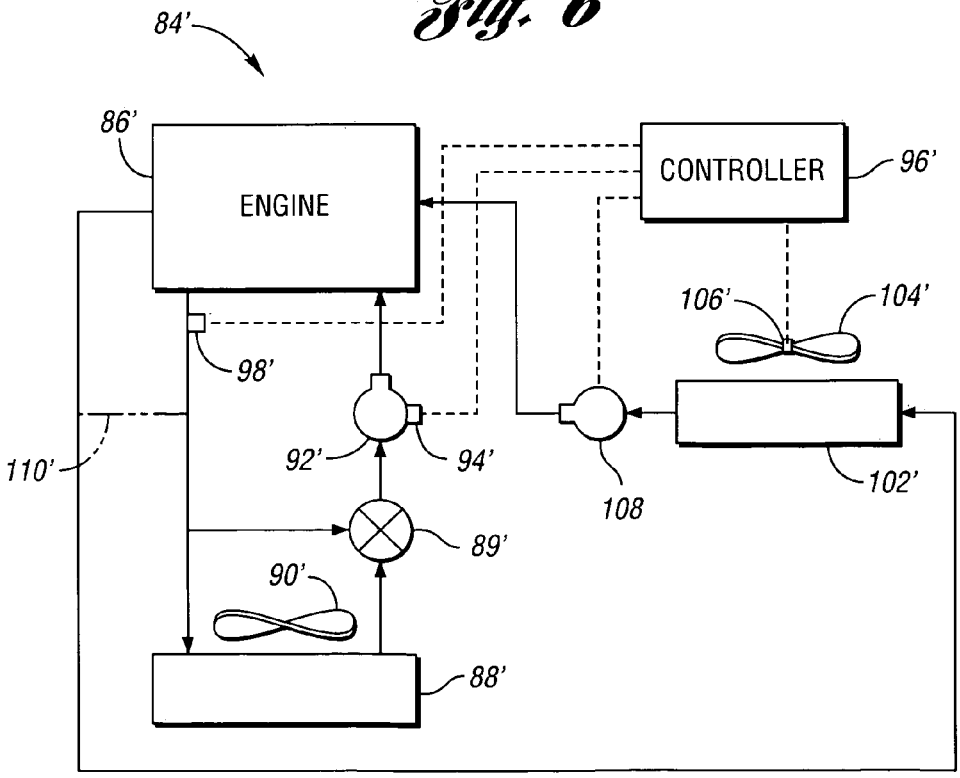
FIG. 6A is a schematic representation of a third vehicle thermal management system in accordance with the present invention.

FIG. 6A illustrates a variation of the thermal management system 84, shown in FIG. 6; therefore, like components are labeled with the prime symbol in FIG. 6A. The thermal management system 84', shown in FIG. 6A, does not include a valve between the second radiator 102 and the pump 94 (such as the valve 100, shown in FIG. 6). Rather, a second pump 108 is disposed between the second radiator 102' and the engine 86. This system may be particularly useful where the first pump 92' is a mechanical pump whose speed is dependent on the speed of the engine 86. In hot ambient and/or low engine speed conditions, the pump 92' may be operated a speed that is too low to effect adequate cooling. In such a case, the second pump 108, which could be a smaller, electronic pump, could be used to provide the required coolant flow.

Figure 7:
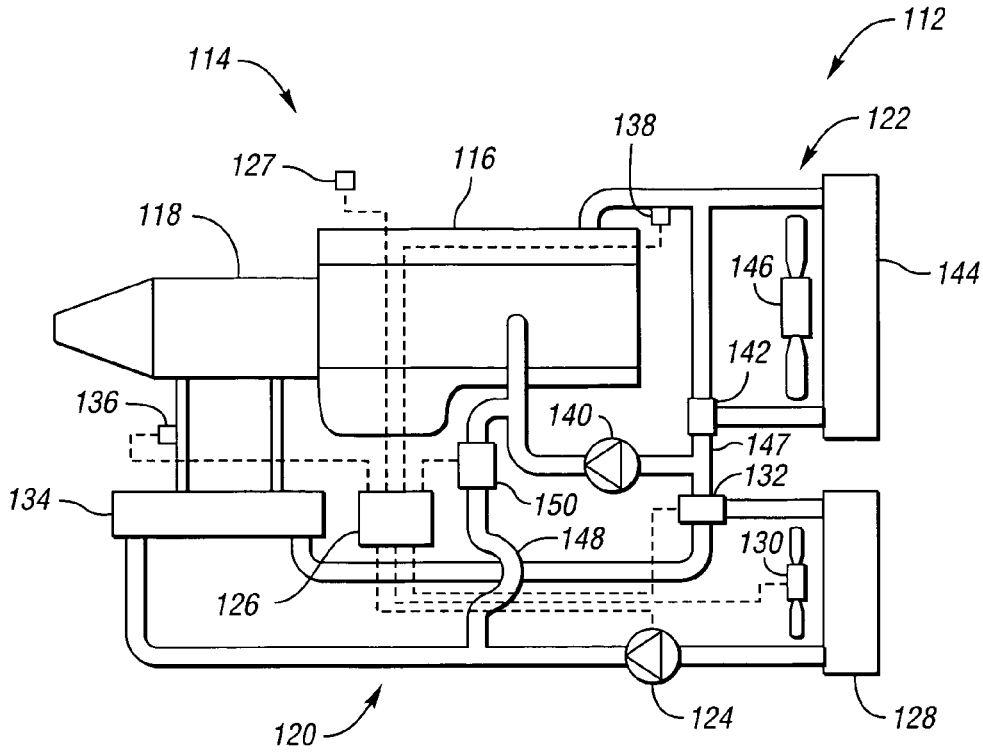
FIG. 7 is a schematic representation of a fourth vehicle thermal management system in accordance with the present invention.

FIG. 7 shows another vehicle thermal management system 112 in accordance with the present invention. A portion of a vehicle 114 is also shown, and includes an engine 116 and a transmission 118. The thermal management system 112 includes a transmission temperature control loop 120 and an engine temperature control loop 122. The transmission temperature control loop includes an electric pump 124 for pumping a first temperature control fluid through the transmission temperature control loop. The pump 124 is in communication with a control system, shown in FIG. 7 as a controller 126. The pump 124 includes a speed sensor, not shown, which allows the controller 126 to be provided with information regarding the operating speed of the pump 124. A temperature sensor 127 in communication with the controller 126 senses the temperature of the ambient air.

The transmission temperature control loop includes a first heat exchanger 128, or first radiator 128, which is configured to facilitate heat transfer between the first temperature control fluid and the ambient air. The transmission temperature control loop 120 also includes an electric fan 130, which is in communication with the controller 126. The fan 130 also includes a speed sensor (not shown) that provides information to the controller 126 regarding the speed of the fan 130. The transmission temperature control loop 120 also includes an electric valve 132 that is operable to control the amount of the first temperature control fluid flowing through the first radiator 128. As with the previous embodiments, the controller 126 can be provided with operation data such that operation of the pump 124 and the fan 130 can be optimized to minimize power consumption.

In addition to flowing through the first radiator 128, the first temperature control fluid in the transmission temperature control loop 120 also flows through a heat exchanger 134. The heat exchanger 134 is in fluid communication with the transmission 118, such that transmission oil is pumped from the transmission 118 into the heat exchanger 134, where heat is transferred between the first temperature control fluid and the transmission oil. As described in more detail below, the thermal management system 112 is configured such that the transmission oil may receive heat from the first temperature control fluid when the transmission oil temperature is too cool, and alternatively, may give off heat to the first temperature control fluid when the transmission oil temperature is too warm. A temperature sensor 136 is used to sense the temperature of the transmission oil, and send a signal related to the sensed temperature to the controller 126. Thus, the transmission temperature control loop 120 is effective to control the temperature of the transmission oil at or near some predetermined temperature, such as 100° C.

The engine temperature control loop 122 also includes a temperature sensor 138, which senses the temperature of a second temperature control fluid that is pumped by a pump 140. When the temperature of the second temperature control fluid reaches a predetermined temperature, a valve 142 opens to allow the second temperature control fluid to pass through a heat exchanger, or second radiator 144. A fan 146 is operable to facilitate airflow across the second radiator 144, to increase cooling of the second temperature control fluid. The valve 142 can also prohibit flow of the second temperature control fluid through the radiator 144, such that the second temperature control fluid is not cooled. As shown in FIG. 7, the pump 140 and the fan 146 are mechanical components, driven by the engine 116. Of course, electric components could be used, as desired. Moreover, the valve 142 can be a thermostatic valve that is not electrically controlled by the controller 126.

The thermal management system 112 also includes a first conduit 147 disposed between the engine temperature control loop 122 and the valve 132. A second conduit 148 is disposed between the engine temperature control loop and the transmission temperature control loop, and an electric valve 150 is disposed in line with the second conduit 148. In this way, the valves 132, 150 facilitate mixing of the first and second temperature control fluids, thereby creating a third temperature control loop. This allows the mixed temperature control fluid to bypass both radiators 128, 144 to attain a relatively high temperature. This allows the transmission oil entering the heat exchanger 134 to receive heat from the mixed temperature control fluid to quickly warm the transmission oil after engine startup, or during cold weather conditions. Alternatively, the valves 132 and 150 can prohibit mixing of the first and second temperature control fluids, and the transmission oil can reject heat into the second temperature control fluid, which is then cooled in the radiator 128.

Figure 8:
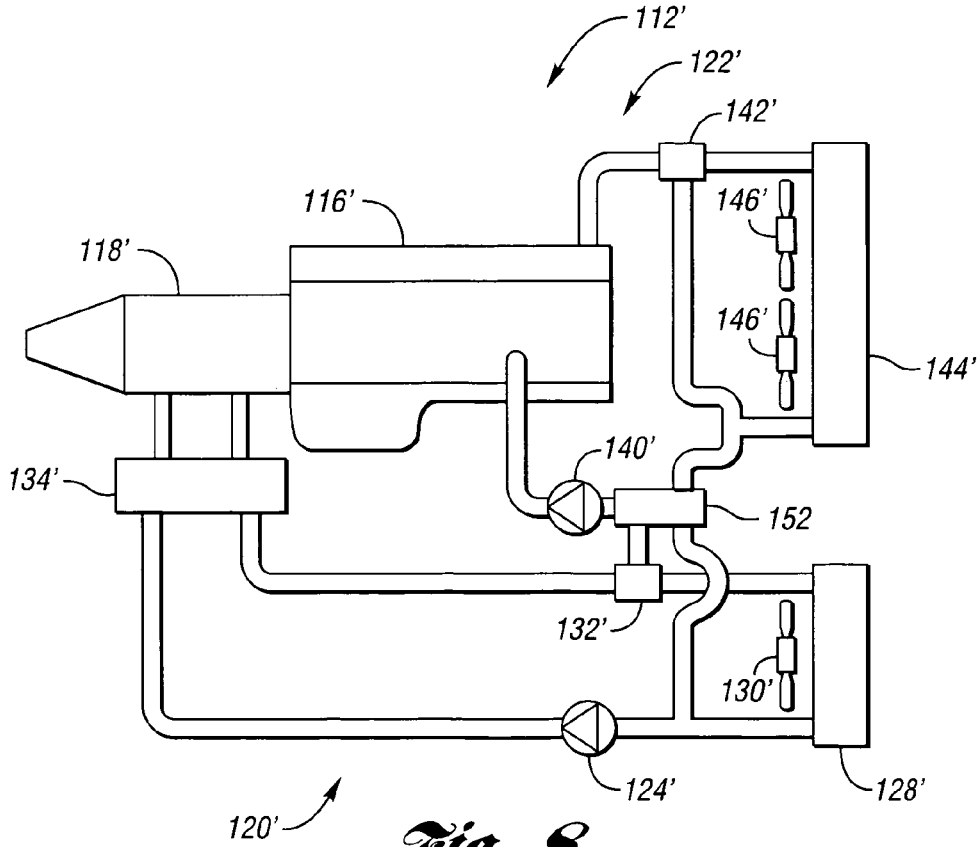
FIG. 8 is a schematic representation of a fifth vehicle thermal management system in accordance with the present invention.

FIG. 8 shows a variation of the vehicle thermal management system 112 shown in FIG. 7; therefore, numerical labels having the prime symbol are used to designate like components. Moreover, some components, like the controller 126, have been omitted for clarity. The vehicle thermal management system 112', shown in FIG. 8, includes a transmission temperature control loop 120' for controlling the temperature of a transmission 118', and an engine temperature control loop 122' for controlling a temperature of an engine 116'. The primary difference between the thermal management systems 112, 112', shown respectively in FIGS. 7 and 8, is that the first and second temperature control fluids do not mix. Rather, a liquid-to-liquid heat exchanger 152 allows heat to be transferred between the first and second temperature control fluids, while still keeping them separate from one another. In addition, the radiator 144' has two fans 146' to facilitate airflow over the radiator 144' to increase cooling. It is worth noting that in any of the embodiments described herein, a single fan can be replaced with multiple fans as desired.

Figure 9:
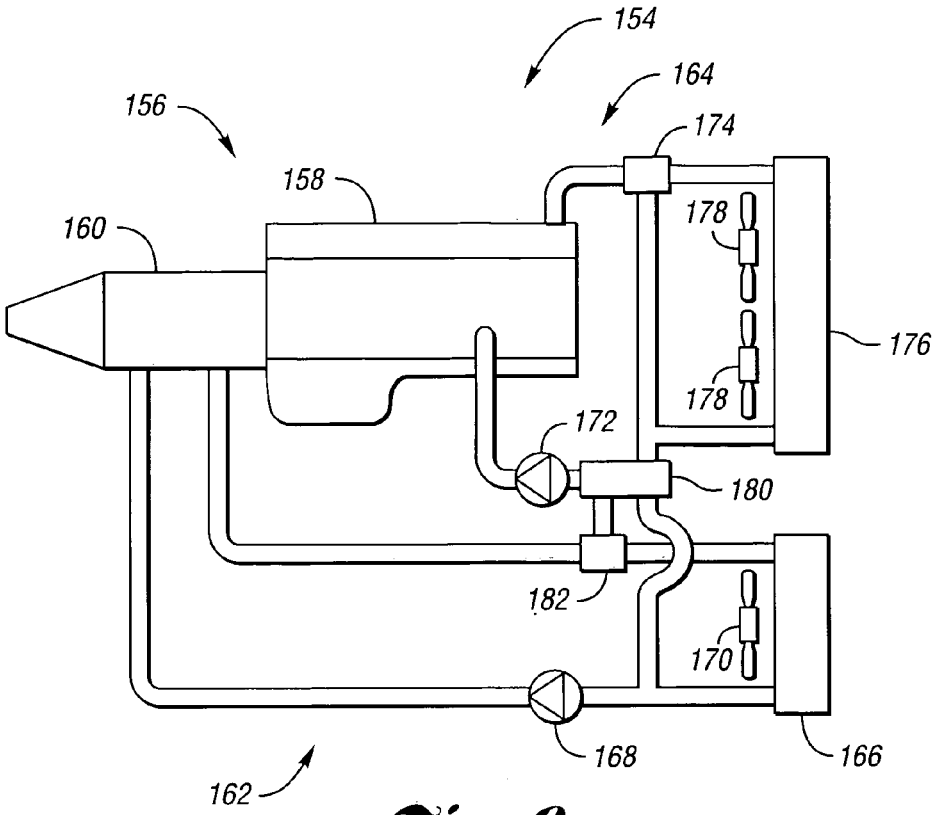
FIG. 9 is a schematic representation of a sixth vehicle thermal management system in accordance with the present invention.

FIG. 9 shows another variation of a vehicle thermal management system 154 in accordance with the present invention. A portion of a vehicle 156 is also shown, including an engine 158 and a transmission 160. The thermal management system 154 includes a transmission temperature control loop 162 and an engine temperature control loop 164. Similar to the configurations shown in FIGS. 7 and 8, the transmission temperature control loop 162 includes a heat exchanger 166 that is used to help cool a temperature of the transmission oil. Unlike the embodiment shown in FIGS. 7 and 8, however, the heat exchanger 166 receives the transmission oil directly, and facilitates the transfer of heat from the transmission oil directly to the ambient air. A pump 168, which in this embodiment is external to the transmission 160, pumps the transmission oil through the transmission temperature control loop 162. A fan 170 is operable to facilitate airflow across the heat exchanger 166, to increase the cooling of the transmission oil. Although not shown in FIG. 9, a control system can be configured to operate the pump 168 and the fan 170 in accordance with optimized operation data as described above.

The engine temperature control loop 164 includes a pump 172 for circulating engine coolant. A bypass valve 174, which may be electric or thermostatic, is operable to control the amount of engine coolant that flows through a radiator 176. As with the embodiment shown in FIG. 8, two fans 178 are operable to facilitate airflow across the radiator 176. Similar to the thermal management system 112', shown in FIG. 8, the thermal management system 154 also includes a heat exchanger 180 disposed between the two temperature control loops 162, 164. Unlike the heat exchanger 152, shown in FIG. 8, the heat exchanger 180 facilitates the transfer of heat between the engine coolant and the transmission oil.

Therefore, upon engine startup or during cold weather conditions, when the transmission oil temperature is cold, a valve 182 can direct the transmission oil through the heat exchanger 180 and back into the transmission 160. At the same time, the valve 174 can direct the engine coolant past the radiator 176, such that the engine coolant temperature is relatively high. This allows heat from the engine coolant to be transferred directly to the transmission oil via the heat exchanger 180. This allows both the engine 158 and the transmission 160 to reach optimum operating temperatures more quickly, and to continuously maintain an efficient transmission operating temperature of approximately 100° C. This can extend the life of the transmission 160, and help to improve fuel economy and reduce exhaust emissions.

Figure 10:
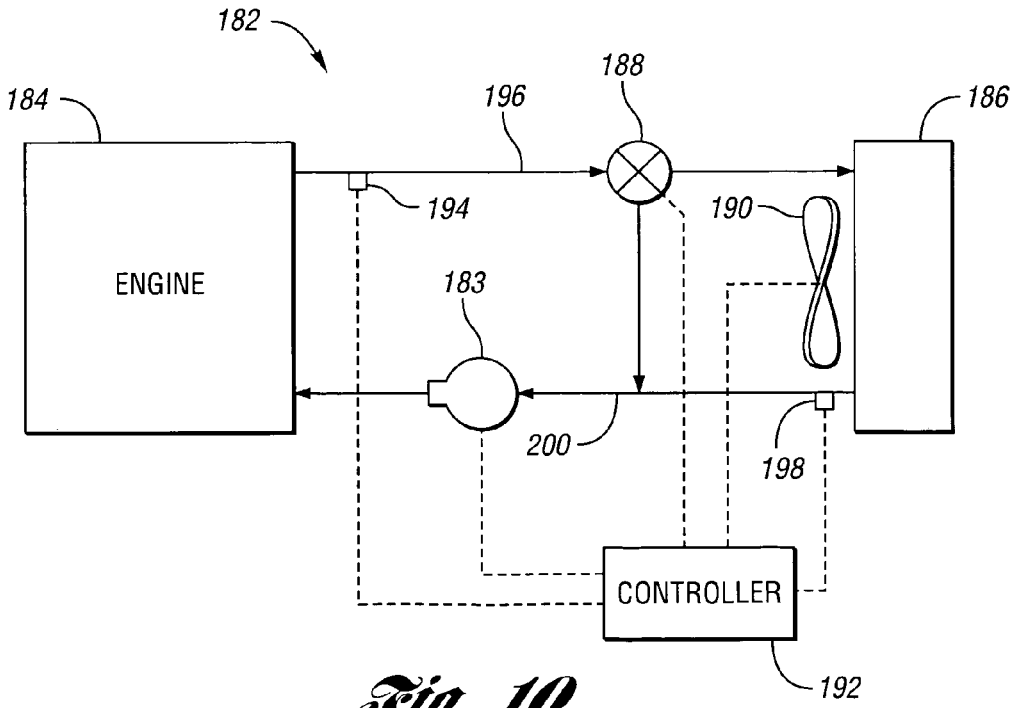
FIG. 10 is a schematic representation of a seventh vehicle thermal management system in accordance with the present invention.

FIG. 10 shows another thermal management system 182 in accordance with the present invention. The thermal management system 182 circulates a coolant via a pump 183 through an engine 184 and a heat exchanger, or radiator 186. A bypass valve 188 is operable to prohibit some or all of the coolant from passing through the radiator 186. A fan 190 is operable to move air across the radiator 186. It is understood that more than one fan may be used to move air across the radiator 186, particularly where large heat exchangers are used.

A control system, including controller 192 controls operation of the pump 183, the valve 188, and the fan 190. In some systems, particularly where the electrical power is not available to operate an electric pump, a mechanical pump may be driven by a connection to the engine 184. The controller 192 receives inputs from a first temperature sensor 194, which is disposed on an outlet side 196 of the engine 184, and a second temperature sensor 198, which is disposed on an inlet side 200 of the engine 184. The first and second temperature sensors 194, 198 respectively provide signals to the controller 192 indicative of the engine inlet and outlet coolant temperatures.

The controller 192 is configured to optimize operation of the various components, while maintaining the inlet and outlet coolant temperatures at or near some predetermined target. For example, the engine outlet temperature, as sensed by the temperature sensor 194, can be controlled by operation of the pump 183 and the valve 188, independent of operation of the fan 190. Conversely, the fan 190 can be operated independent of the pump 183 and the valve 188 to maintain the inlet temperature at or near some predetermined target. In this way, the controller 192 can operate the more energy efficient pump 183 and valve 188 to control the outlet temperature, without resorting to the use of the fan 190. Indeed, it is only when the inlet temperature becomes too high that the fan 190 is used at all. Thus, the larger power consumption associated with the fan 190 is minimized, and overall power consumption is reduced.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A thermal management system for a heat producing system, the thermal management system comprising:

a first temperature control fluid for controlling the temperature of at least a portion of the heat producing system;

a first temperature sensor for sensing a temperature of the first temperature control fluid, and outputting a signal related to the temperature of the first temperature control fluid;

a first heat exchanger for transferring heat between the first temperature control fluid and ambient air;

a second temperature sensor for sensing a temperature of the ambient air, and outputting a signal related to the temperature of the ambient air;

a first fan operable to move the ambient air across the first heat exchanger, the first fan being a variable speed electric fan;

a first pump operable to pump the first temperature control fluid through the first heat exchanger, the first pump being a variable speed electric pump; and a control system operatively connected to the temperature sensors, the first fan, and the first pump and including at least one controller, the control system being programmed with operation data providing optimized operating speeds for combined operation of the first fan and the first pump, each of the optimized operating speeds corresponding to an amount of heat transfer between the first temperature control fluid and the ambient air via the first heat exchanger at a respective ambient air temperature, and each of the optimized operating speeds providing a minimized combined power input into the first fan and the first pump for the corresponding amount of heat transfer, the control system being configured to operate the first fan and the first pump at the optimized operating speeds based at least in part on the operation data and signals received from the temperature sensors.

2. The thermal management system of claim 1, the heat producing system including an engine in a vehicle, and wherein the control system receives an input related to a speed of the vehicle, and is further configured to operate the first fan and the first pump at the optimized operating speeds based at least in part on the input received.

3. The thermal management system of claim 2, further comprising a load sensor for sensing a load on the engine and outputting a signal related to the engine load to the control system, and wherein the control system is further configured to effect transient operation of the first fan and the first pump based at least in part on the sensed engine load, the transient operation occurring immediately following a change in engine load.

4. The thermal management system of claim 1, wherein the operation data includes at least one equation defining an optimization curve having one of the speed of the first fan and the speed of the first pump as an independent variable, and the other of the speed of the first fan and the speed of the first pump as a dependent variable.

5. The thermal management system of claim 1, wherein at least some of the operation data includes a lookup table.

6. The thermal management system of claim 1, wherein the operation data includes data gathered from testing a model of at least a portion of the thermal management system.

7. The thermal management system of claim 1, further comprising:

a first speed sensor for the sensing the speed of the first pump and outputting a signal related to the speed of the first pump to the control system; and a second speed sensor for sensing the speed of the first fan and outputting a signal related to the speed of the first fan to the control system, and wherein the control system is further configured to:

a) determine a temperature error defined as the difference between the sensed temperature of the first temperature control fluid and the first target temperature, b) determine a current operating point from the operation data based on a sensed speed of at least one of the first fan and the first pump, and c) determine a new operating point from the operation data based on the current operating point and the magnitude and the sign of the temperature error.

8. The thermal management system of claim 1, further comprising:

a first electric valve in communication with the control system and operable to prohibit at least some of the first temperature control fluid from passing through the first heat exchanger, and wherein the control system is further configured to:

a) operate the first pump at a first predetermined pump speed and actuate the first valve to prohibit the first temperature control fluid from passing through the first heat exchanger when the sensed temperature of the first temperature control fluid is below a first temperature set point, b) actuate the first valve to allow at least some of the first temperature control fluid to pass through the first heat exchanger when the sensed temperature of the first temperature control fluid reaches the first temperature set point, and c) increase the speed of the first pump to one of the optimized operating speeds when the sensed temperature of the first temperature control fluid reaches a second temperature set point greater than the first temperature set point.

9. The thermal management system of claim 8, wherein the control system is further configured to prohibit starting the first fan when the speed of the first pump is below a second predetermined pump speed, and to operate the first fan at one of the optimized operating speeds based on the speed of the first pump when the speed of the first pump is at or above the second predetermined pump speed.

10. The thermal management system of claim 1, the heat producing system including an engine in a vehicle, the thermal management system further comprising:

an exhaust gas cooler in communication with the engine and configured to receive exhaust gas from the engine at a first temperature, and to recirculate the exhaust gas back into the engine at a second temperature lower than the first temperature, and wherein the first pump is operable to pump the first temperature control fluid through the exhaust gas cooler, thereby facilitating heat transfer between the first temperature control fluid and the exhaust gas.

11. The thermal management system of claim 1, the heat producing system including an engine and a transmission in a vehicle, and wherein the first temperature control fluid is used to control at least one of a temperature of the transmission and a temperature of the engine.

12. The thermal management system of claim 11, further comprising:

a second temperature control fluid for controlling the temperature of recirculated exhaust gas entering the engine;

a third temperature sensor for sensing a temperature of the second temperature control fluid, and for outputting a signal related to the temperature of the second temperature control fluid to the control system;

a second heat exchanger for transferring heat between the second temperature control fluid and the ambient air;

a second fan in communication with the control system and operable to move the ambient air across the second heat exchanger;

an exhaust gas cooler in communication with the engine and configured to receive exhaust gas from the engine at a first temperature, and to recirculate the exhaust gas back into the engine at a second temperature lower than the first temperature; and a second variable speed electric pump in communication with the control system, the second pump being operable to pump the second temperature control fluid through the second heat exchanger and through the exhaust gas cooler, thereby facilitating heat transfer between the second temperature control fluid and the exhaust gas, and wherein the control system is programmed with operation data providing optimized operating speeds for combined operation of the second fan and the second pump, each of the optimized operating speeds for the second fan and the second pump corresponding to an amount of heat transfer between the second temperature control fluid and the ambient air via the second heat exchanger at a respective ambient air temperature, and each of the optimized operating speeds for the second fan and the second pump providing a minimized combined power input into the second fan and the second pump for the corresponding amount of heat transfer, the control system being configured to operate the second fan and the second pump at the optimized operating speeds based at least in part on the operation data for the second fan and the second pump and signals received from the second and third temperature sensors, thereby effecting heat transfer between the second temperature control fluid and the ambient air to drive the temperature of the second temperature control fluid toward a second target temperature.

13. The thermal management system of claim 11, further comprising:

a first electric valve in communication with the control system and operable to prohibit at least some of the first temperature control fluid from passing through the first heat exchanger;

a first temperature control loop including the first heat exchanger, the first electric valve, and the first pump, the first temperature control loop being configured to facilitate heat transfer between the first temperature control fluid and the transmission;

a second temperature control loop including a second temperature control fluid, a second heat exchanger for facilitating heat transfer between the second temperature control fluid and the ambient air, and a second fan operable to move the ambient air across the second heat exchanger, the second temperature control loop being in selective communication with the first temperature control loop, thereby facilitating mixing of the first and second temperature control fluids, the second temperature control loop being configured to facilitate heat transfer between the second temperature control fluid and the engine.

14. The thermal management system of claim 13, wherein the first valve is operable to allow selective fluid communication between the first and second temperature control loops, the thermal management system further comprising:

a second electric valve in communication with the control system and operable to allow selective fluid communication between the first and second temperature control loops; and a third temperature control loop including at least a portion of the first and second temperature control loops, and resulting from at least partial opening of the first and second valves, the third temperature control loop being configured to facilitate heat transfer between the engine and the transmission.

15. The thermal management system of claim 14, the transmission including transmission oil, the thermal management system further comprising a third heat exchanger configured to facilitate heat transfer between the first temperature control fluid and the transmission oil, and wherein the second and third temperature control loops include the third heat exchanger.

16. A method for managing thermal characteristics of a heat producing system, the heat producing system including a first cooling loop, the first cooling loop including a first temperature control fluid for controlling the temperature of at least a portion of the heat producing system, a first heat exchanger for transferring heat between the first temperature control fluid and ambient air, a first fan for moving the ambient air across the first heat exchanger, and a first pump for pumping the first temperature control fluid through the first heat exchanger, the method comprising:

determining coefficients of performance for combined operation of the first fan and the first pump, each of the coefficients of performance being defined as a ratio of the amount of heat transfer between the first temperature control fluid and the ambient air via the first heat exchanger during operation of at least one of the first fan and the first pump to the combined power input into the first fan and the first pump at a respective ambient air temperature;

determining a temperature of the first temperature control fluid;

determining a temperature of the ambient air;

comparing the temperature of the first temperature control fluid to a first target temperature;

operating at least one of the first fan and the first pump based at least in part on the coefficients of performance and the comparison of the temperature of the first temperature control fluid to the first target temperature, thereby effecting a change in the temperature of the first temperature control fluid toward the first target temperature.

17. The method of claim 16, further comprising:

determining maximum coefficients of performance for corresponding operating speeds of the first fan and the first pump, each of the maximum coefficients of performance corresponding to a minimum combined power input into the first fan and the first pump for a corresponding amount of heat transfer at a respective ambient air temperature, and wherein the operation of at least one of the first fan and the first pump is based at least in part on the maximum coefficients of performance.

18. The method of claim 17, wherein the comparison of the temperature of the first temperature control fluid to the first target temperature includes determining the difference between them, thereby defining a temperature error, the method further comprising:

determining a current operating speed for at least one of the first fan and the first pump;

determining a current maximum coefficient of performance based on at least one of the current operating speed of the first fan and the first pump; and operating at least one of the first fan and the first pump based on the current maximum coefficient of performance and the magnitude and the sign of the temperature difference.

19. The method of claim 18, the cooling loop further including a first electric valve operable to prohibit at least some of the first temperature control fluid from passing through the first heat exchanger, the method further comprising:

operating the first pump at a first predetermined pump speed and actuating the first valve to prohibit the first temperature control fluid from passing through the first heat exchanger when the determined temperature of the first temperature control fluid is below a first temperature set point, actuating the first valve to allow at least some of the first temperature control fluid to pass through the first heat exchanger when the determined temperature of the first temperature control fluid reaches the first temperature set point, and increasing the speed of the first pump to a speed corresponding to one of the maximum coefficients of performance when the determined temperature of the first temperature control fluid increases to at least a second temperature set point.

20. The method of claim 19, further comprising:

prohibiting starting the first fan when the speed of the first pump is below a second predetermined pump speed; and operating the first fan at a speed corresponding to one of the maximum coefficients of performance based on the speed of the first pump when the speed of the first pump is at or above the second predetermined pump speed.

21. A thermal management system for a vehicle, the vehicle including an engine and a transmission containing transmission oil, the thermal management system comprising:

a transmission temperature control loop for controlling a temperature of the transmission, the transmission temperature control loop including a first pump operable to pump a first temperature control fluid through the transmission temperature control loop, a first radiator for transferring heat between the first temperature control fluid and ambient air, a first fan operable to move the ambient air across the first radiator, a first valve operable to control the amount of the first temperature control fluid passing through the first radiator, and a heat exchanger in fluid communication with the first radiator for transferring heat between the first temperature control fluid and the transmission oil;

an engine temperature control loop for controlling a temperature of the engine, the engine temperature control loop including a second pump operable to pump a second temperature control fluid through the engine temperature control loop, a second radiator for transferring heat between the second temperature control fluid and the ambient air, a second fan operable to move the ambient air across the second radiator, and a second valve operable to control the amount of the second temperature control fluid passing through the second radiator;

a first conduit disposed between the engine temperature control loop and the second valve, the second valve being further operable to facilitate mixing of the first and second temperature control fluids;

a second conduit disposed between the engine temperature control loop and the transmission temperature control loop;

a third valve operable control flow through the second conduit, thereby facilitating mixing of the first and second temperature control fluids; and a control system including at least one controller, the control system being configured to operate at least the first fan, the first pump, and the first and third valves.

22. A thermal management system for a vehicle, the vehicle including an engine and a transmission containing transmission oil, the thermal management system comprising:

a transmission temperature control loop for controlling a temperature of the transmission, the transmission temperature control loop including a first pump operable to pump a first temperature control fluid through the transmission temperature control loop, a first radiator for transferring heat between the first temperature control fluid and ambient air, a first fan operable to move the ambient air across the first radiator, a first valve operable to control the amount of the first temperature control fluid passing through the first radiator, and a first heat exchanger in fluid communication with the first radiator for transferring heat between the first temperature control fluid and the transmission oil;

an engine temperature control loop for controlling a temperature of the engine, the engine temperature control loop including a second pump operable to pump a second temperature control fluid through the engine temperature control loop, a second radiator for transferring heat between the second temperature control fluid and the ambient air, a second fan operable to move the ambient air across the second radiator, and a second valve operable to control the amount of the second temperature control fluid passing through the second radiator;

a second heat exchanger in fluid communication with the first and second radiators for transferring heat between the first temperature control fluid and the second temperature control fluid; and a control system including at least one controller, the control system being configured to operate at least the first fan and the first valve.

23. A thermal management system for a heat producing system, the thermal management system comprising:

a temperature control fluid for controlling the temperature of at least a portion of the heat producing system;

a temperature sensor for sensing a temperature of the temperature control fluid, and outputting a signal related to the sensed temperature;

a first heat exchanger capable of receiving at least some of the temperature control fluid for transferring heat between the temperature control fluid and ambient air;

a first fan operable to move the ambient air across the first heat exchanger;

a first pump operable to pump the temperature control fluid through at least the first heat exchanger;

a second heat exchanger capable of receiving at least some of the temperature control fluid for transferring heat between the temperature control fluid and the ambient air;

a second fan operable to move the ambient air across the second heat exchanger, the second fan being a variable speed electric fan;

a control system including at least one controller, the control system being operatively connected to at least the temperature sensor and the second fan, and configured to operate the second fan based at least in part on signals received from the temperature sensors; and a second pump operable to pump the temperature control fluid through the second heat exchanger and operatively connected to the control system, the control system being further configured to operate the second pump to control the flow of the temperature control fluid through the second heat exchanger based at least in part on signals received from the temperature sensor.

* * * * *